United States Patent [19]

Herrera-Gutierrez

[11] 4,027,819

[45] June 7, 1977

[54] CLOSURE DEVICE FOR BAGS OR SIMILAR CONTAINERS

[76] Inventor: Jesus Herrera-Gutierrez, Escobedo Sur 733-201, Monterrey, N.L., Mexico

[22] Filed: Mar. 29, 1976

[21] Appl. No.: 671,506

[52] U.S. Cl. ..... 229/65; 24/30.5 R; 229/66

[51] Int. Cl.[2] ..... B65D 33/30

[58] Field of Search ..... 229/65, 66, 62; 24/30.5 R; 150/3

[56] References Cited

UNITED STATES PATENTS

| | | | |
|---|---|---|---|
| 1,069,044 | 7/1913 | Traub | 229/65 |
| 1,639,759 | 8/1927 | Whelan | 229/66 |
| 2,041,375 | 5/1936 | Schmerler | 229/65 X |
| 2,093,974 | 9/1937 | Farmer | 229/65 X |
| 2,142,330 | 1/1939 | Nydegger | 229/62 |
| 2,369,716 | 2/1945 | Coghill | 229/62 X |
| 2,843,309 | 7/1958 | Wheeler | 229/65 X |
| 3,815,810 | 6/1974 | Wellman | 229/66 X |

*Primary Examiner*—Stephen P. Garbe
*Attorney, Agent, or Firm*—Laurence R. Brown

[57] ABSTRACT

A closure device made of flexible metal having in the middle, a weakened section which permits folding it, to form two segments, for adapting it to the corner of any bag or similar container.

As the segments are folded, to be assembled to the corner of the bag, upon one of the segments, are clinched to a band on the other segment for sandwiching the corner of the bag.

Both segments have along one side, perforations, through which knives a Stapling or assembling Machine will pass to cut the bag between the segments.

To open the bag, a part of the segments, with the corner of the bag held between them, must be separated from the band, ears and bag, by repeated bending of the segments to break at joints for tearing the corner off. Only the band with the ears attached to the bag remain to permit opening or closing the mouth of the bag.

6 Claims, 5 Drawing Figures

CLOSURE DEVICE FOR BAGS OR SIMILAR CONTAINERS

This invention relates to a closure device for bags or similar containers made of flexible metal, having in its middle a weakened section, which will permit folding and placing in the corner of any bag, preferably a plastic bag. By repeated bending a portion of the closure can be removed. When this is done, also the corner of the bag held between metal segments will be torn away, producing a mouth in the bag. A metal band is left assembled to the mouth of the bag for use to close or open the mouth.

The advantages provided by such closure, are to provide means to open and close the mouth of any plastic bag and also to facilitate the operation of pouring out the contents of any bag, especially certain types of dust or granular substances for which pouring is difficult to control.

Other objectives and advantages of the invention will become apparent during the course of the following description.

The details and characteristics of the device are shown clearly in the following description, and on the drawings which have the same reference symbols to indicate the same parts in the different figures.

Figure 1:
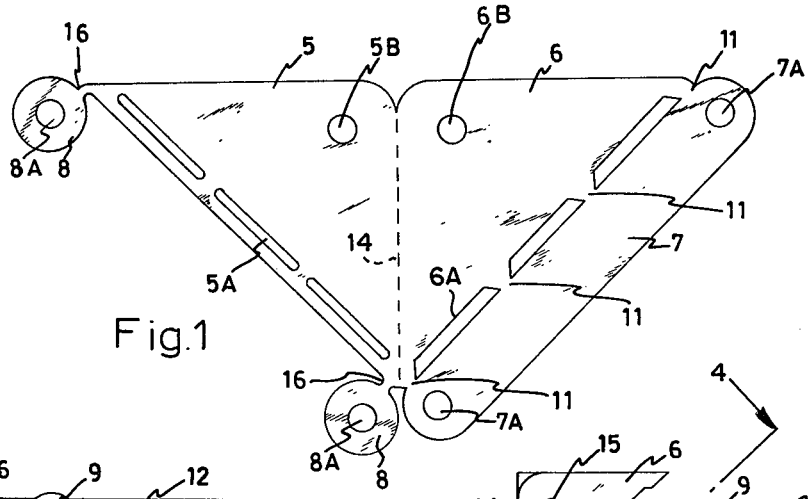
FIG. 1, is an elevation view of the closure before it is assembled to the bag.
Figure 2:
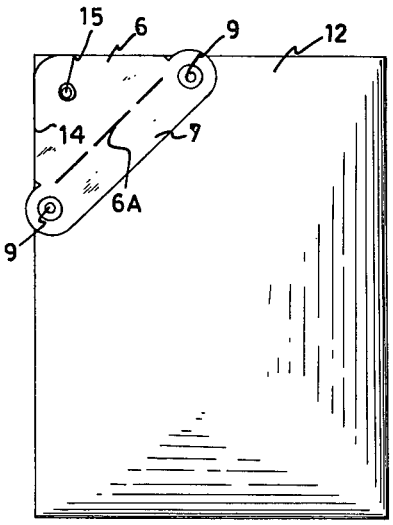
FIG. 2 is an elevation view once the closure has been assembled to the bag, showing also the position of the band, the bolts, and one of the segments.
Figure 3:
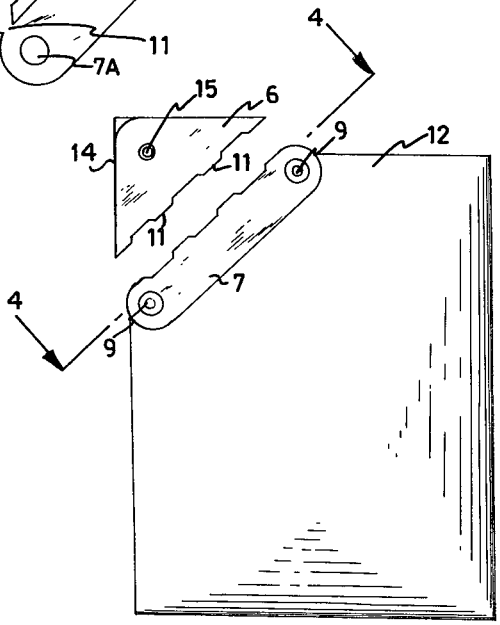
FIG. 3 is a plan view of the bag once the segments have been torn off, showing also the position of the band assembled to the bag.

Referring now to the drawings, this closure is shaped as an irregular triangular element, having in its middle a weakened section 14 which permits folding to form two segments 5, 6. These segments have also a triangular shape so they can be assembled to the corner of any bag or similar container. For such purpose the closure will be folded in its middle weakened section 14 bringing the segments 5, 6 one against the other, holding therebetween the corner of the bag.

One of the segments 5 has two ears 8 with one hole 8A each of which can be torn apart from the segment 5 by repeated bending due to the fact that the ears 8 join the segment by means of two thin joints 16. Both segments 5, 6 have along one of its sides, perforations 5A, 6A, through which the knives of the stapling machine that assembles the closure to the bag, will cut the body of the bag 12. The segments have one upper hole 5B, 6B each, through which the bolt 15 will pass to clinch the segments. The perforations 6A form a band 7 which separates from the segment 6 by breaking the joints 11 by repeated bending. This band 7 has two holes 7A to let the bolts 9 pass when clinched to the ears 8.

When the closure has been folded and the segments 5, 6 are together holding therebetween the corner of the bag or similar container, these segments 5, 6 will be clinched together by means of two lower bolts 9 and one upper bolt 15.

The lower bolts 9 pass through holes 8A of the ears 8, the bag 12, and the holes 7A of the band 7, steadily securing the band 7 to the ears 8 and consequently to the corner of the bag remaining between the ears 8 and the band 7. The upper bolt 15 passes through the upper part of the segments 5, 6 and the upper part of the corner of the bag 12 attaching them together. When such operation has been completed the closure is assembled to the bag.

To open the bag, the segments 5, 6 will be torn off by repeated bending of the joints 11, 16, that keep the segments 5, 6 joined to the band 7 and to the ears 8. When the segments 5, 6 are torn off, also the corner of the bag between the segments 5, 6 will be torn because of the cuts produced to the corner of the bag 12 by the knives of the stapling machine. When the corner of the bag 12 is torn away, a mouth 13 is produced in the bag 12.

After the whole operation described above has been done, the closure is ready to work by action of the band 7, that is firmly attached to the body of the bag 12, by means of the lower bolts 9 and the ears 8.

Figure 5:
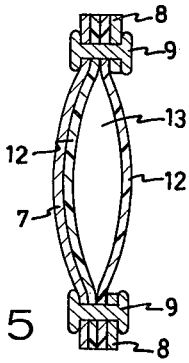
FIG. 5, is a similar cross sectional view of the band, the bolts and the mouth in an open position.

To open and keep the mouth 13 of the bag open (FIG. 5), the band 7 will be bent since it is manufactured of a flexible metal. It will remain bent as long as it is necessary to keep the mouth 13 of the bag open to permit easy pouring of the contents of the bag.

Figure 4:
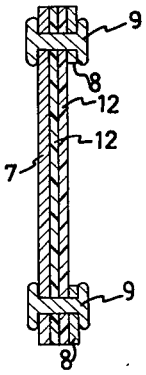
FIG. 4, is a cross sectional view of the band, the mouth, and the bolts in a closed position looking into the corner of the bag along lines 4—4 of FIG. 3.

To close the mouth 13, it will be necessary to straighten the band 7 to its original position, (FIG. 4).

It is obvious that the dimensions of the closure will vary according to the dimensions of the bag to which such closure is to be adapted.

It is also to be understood that the forms of the invention herewith shown and described are to be taken as preferred examples of the same, and the various changes in the shape, size and arrangement of parts may be made without departing from the spirit of the invention or the scope of the claims.

What is claimed is:

1. A closure device for affixing to the corner of a flexible bag, comprising in combination, a planar sheet of flexible metal substantially triangular in form having a weakened fold line therein for folding over two interconnected substantially triangular segments and sandwiching between them the corner of a bag, mating apertures located substantially at corners of said two triangular segments to receive clasping structure for holding the segments in place on the corner of a bag, slots defined along that edge of at least one segment which will occupy a position furthermost from the corner of the bag thereby defining an edge band, said slots also being for receiving knife structure to perforate for ready removal the corner of a bag when held between said two segments, narrow metallic joints formed on each segment positioned for breaking off a substantially triangular corner section with repeated bending when affixed to a bag thereby leaving said edge band and at least two of said mating apertures affixed to the bag and thereby for removing a corner section of the bag defined along said slots with the broken off corner section thereby defining a mouth in one corner of the bag, wherein said flexible metal band has a characteristic such that it may be bent to hold open the mouth of the bag for removal of contents and restraightened to hold the mouth closed.

2. A closure device as defined in claim 1 wherein there are three said mating apertures at all three corners of each of said triangular segments.

3. A closure device as defined in claim 1 wherein said narrow metallic joints on one segment are located between said slots.

4. A closure as defined in claim 3 wherein said narrow metallic joints on the remaining segment are located adjacent said mating apertures to thereby dispose said band on only one side of the bag and a set of ears about said apertures on the other side of the bag.

5. A closure as defined in claim 1 affixed on the corner of a bag by means of fasteners extending through said mating apertures.

6. A closure as defined in claim 5 wherein the bag defines mating slots registered with those defining said edge band.

* * * * *